US009398778B2

(12) United States Patent
Blinka et al.

(10) Patent No.: US 9,398,778 B2
(45) Date of Patent: Jul. 26, 2016

(54) WATER-RESISTANT WADERS INCORPORATING A WAIST LOCK SYSTEM

(71) Applicant: Academy, Ltd., Katy, TX (US)

(72) Inventors: Michael Blinka, Richmond, TX (US); Jacob Andrewson, Katy, TX (US)

(73) Assignee: Academy, Ltd., Katy, TX (US)

( * ) Notice: Subject to any disclaimer, the term of this patent is extended or adjusted under 35 U.S.C. 154(b) by 71 days.

(21) Appl. No.: 14/076,874

(22) Filed: Nov. 11, 2013

(65) Prior Publication Data

US 2014/0130230 A1 May 15, 2014

Related U.S. Application Data

(60) Provisional application No. 61/725,272, filed on Nov. 12, 2012.

(51) Int. Cl.
*A41D 13/012* (2006.01)
*A41F 9/02* (2006.01)

(52) U.S. Cl.
CPC ..... *A41D 13/012* (2013.01); *A41F 9/025* (2013.01)

(58) Field of Classification Search
CPC ..... A41D 1/06; A41D 1/08; A41D 13/0015; A41D 13/02; A41D 13/1254; A41D 13/0002; A41D 13/012; A41F 9/002; A41F 9/00; A41F 9/02; A41F 9/025
USPC ..... 2/82, 311, 79, 227, 235, 236, 237, 312, 2/320, 321
See application file for complete search history.

(56) References Cited

U.S. PATENT DOCUMENTS

| | | | | |
|---|---|---|---|---|
| 3,465,375 | A | 9/1969 | Schnell | |
| 4,535,477 | A | 8/1985 | Musto et al. | |
| 4,561,121 | A * | 12/1985 | Ehring et al. | 2/455 |
| 4,858,342 | A * | 8/1989 | Nicholson et al. | 36/109 |
| 5,050,244 | A * | 9/1991 | Kleinman | 2/227 |
| RE34,662 | E | 7/1994 | Keller | |
| 5,901,374 | A * | 5/1999 | Foster | 2/82 |
| 6,049,913 | A * | 4/2000 | Harrigan, Jr. | 2/227 |
| 6,154,884 | A * | 12/2000 | Dehner | 2/69 |
| 6,167,571 | B1 * | 1/2001 | Cheng | 2/227 |
| 6,280,807 | B1 * | 8/2001 | Shih | 428/57 |
| 6,317,893 | B1 * | 11/2001 | Walton | 2/227 |
| 6,961,964 | B2 | 11/2005 | Blenkarn | |
| 7,770,235 | B2 * | 8/2010 | Lepage et al. | 2/82 |
| 2010/0132089 | A1 | 6/2010 | Myers | |
| 2010/0229284 | A1 * | 9/2010 | Wilson, II | 2/237 |

FOREIGN PATENT DOCUMENTS

| | | |
|---|---|---|
| GB | 2068213 | 8/1981 |

* cited by examiner

*Primary Examiner* — Andrew W Collins
(74) *Attorney, Agent, or Firm* — Kirby B. Drake; Klemchuk LLP

(57) ABSTRACT

Water-resistant waders may incorporate a waist lock system to reduce the likelihood of water entering the waders below the wearer's waist area while the waders are being worn during water-based activities, such as fishing or hunting. The waders may include a waist lock system formed of a ring of water-resistant material that may be firmly positioned around the waist area of the wearer such that it may create a flap and seal structure. If water reaches the top portion of the waist lock system, the waist lock system generally may prevent or at least minimize the water that may penetrate the waist lock system and enter the waders, particularly below the wearer's waist area, such as the wearer's feet and legs.

19 Claims, 4 Drawing Sheets

WATER-RESISTANT WADERS INCORPORATING A WAIST LOCK SYSTEM

CROSS-REFERENCE TO RELATED APPLICATION

This application claims the benefit under 35 U.S.C. §119 (e) of U.S. Provisional Application No. 61/725,272 filed on Nov. 12, 2012, entitled "Water-Resistant Waders Incorporating a Waist Lock System," the disclosure of which is incorporated by reference in its entirety.

FIELD OF THE DISCLOSURE

The present disclosure generally relates to water-resistant waders, and more particularly to water-resistant waders incorporating a waist lock system.

BACKGROUND

Water-resistant protective clothing known as waders may be worn by individuals participating in a variety of water-based activities, such as fishing or hunting, to reduce the likelihood of getting wet while participating in the activity. While waders may be formed of water-resistant material, the construction of the waders may still be such that circumstances may arise when water may still enter the waders and cause portions of the user's body covered by the waders to become wet.

SUMMARY

Embodiments of the present disclosure may provide a waist lock system for water-resistant waders comprising a band formed of a water-resistant material and having at least one adjustable side strap, and seamtape to attach the band to an upper chest wader portion of the water-resistant waders. The waist lock system also may comprise gripper dots disposed within the interior of the band. The water-resistant material may be selected from the group comprising vulcanized rubber, polyvinyl chloride (PVC), polyurethane, silicone elastomer, neoprene, polyester, and nylon. The band may include adjustable side straps on both sides of the band. At least one adjustable side strap may be adjusted via a fabric hook-and-loop fastener. The band may further comprise a side seam. The seamtape may be formed of a water-resistant material selected from the group comprising vulcanized rubber, polyvinyl chloride (PVC), polyurethane, silicone elastomers neoprene, polyester, and nylon.

Other embodiments of the present disclosure may provide water-resistant waders incorporating a waist lock system, the waders comprising an upper chest wader portion, and the waist lock system comprising a water-resistant band affixed to the upper chest wader portion with a water-resistant seamtape. The waist lock system also may comprise at least one adjustable side strap. At least one adjustable side strap may be adjusted via a fabric hook-and-loop fastener. The waist lock system also may comprise gripper dots disposed within the interior of the band. The water-resistant band may be formed of a material selected from the group comprising vulcanized rubber polyvinyl chloride (PVC), polyurethane, silicone elastomer, neoprene, polyester, and nylon. The waist lock system may further comprise a self-fabric shell side seam. The water-resistant seamtape may be formed of a material selected from the group comprising vulcanized rubber, polyvinyl chloride (PVC), polyurethane, silicone elastomer, neoprene, polyester, and nylon.

Further embodiments of the present disclosure may include a waist lock system for waders, the waist lock system comprising a ring of water-resistant material firmly positioned around a waist area of the waders forming a flap and seal structure, and seamtape to attach the ring of water-resistant material to the waders. The waist lock system may further comprise gripper dots disposed within the interior portion of the ring of water-resistant material. The ring of water-resistant material may also comprise at least one adjustable side strap. At least one adjustable side strap may be adjusted via a fabric hook-and-loop fastener. The ring of water-resistant material may further comprise a self-fabric shell side seam.

BRIEF DESCRIPTION OF THE DRAWINGS

For a more complete understanding of this disclosure, reference is now made to the following description, taken in conjunction with the accompanying drawings, in which.

DETAILED DESCRIPTION

Embodiments of the present disclosure may provide for water-resistant waders incorporating a waist lock system. Inclusion of a waist lock system may reduce the likelihood of water entering the waders below the wearer's waist area while the waders are being worn during water-based activities, such as fishing or hunting. The waist lock system may be formed of a ring of water-resistant material that may be firmly positioned around the waist area of the wearer such that it may create a flap and seal structure. If water reaches the top portion of the waist lock system, the waist lock system generally may prevent or at least minimize the water that may penetrate the waist lock system and enter the waders, particularly below the wearer's waist area, such as the wearer's feet and legs.

A waist lock system according to embodiments of the present disclosure may comprise several components including but not limited to a band, at least one adjustable side strap, and seamtape. The band may be formed of a water-resistant material having a sufficient width so that it fits around a wearer's waist area tightly enough to minimize, and in some cases eliminate, water that may leak into the lower portion of the water-resistant waders below the wearer's waist area. The band may include at least one adjustable side strap to allow a wearer to better fit around his/her waist area, thereby improving the flap and seal structure. Seamtape may be formed of a waterproof or water-resistant material and may be used to attach the band of the waist lock system to the upper chest wader portion of the water-resistant waders according to embodiments of the present disclosure. Gripper dots also may be disposed as part of the interior of the band to provide for more secure adhesion of the waist lock system to the wearer according to embodiments of the present disclosure.

Figure 1:
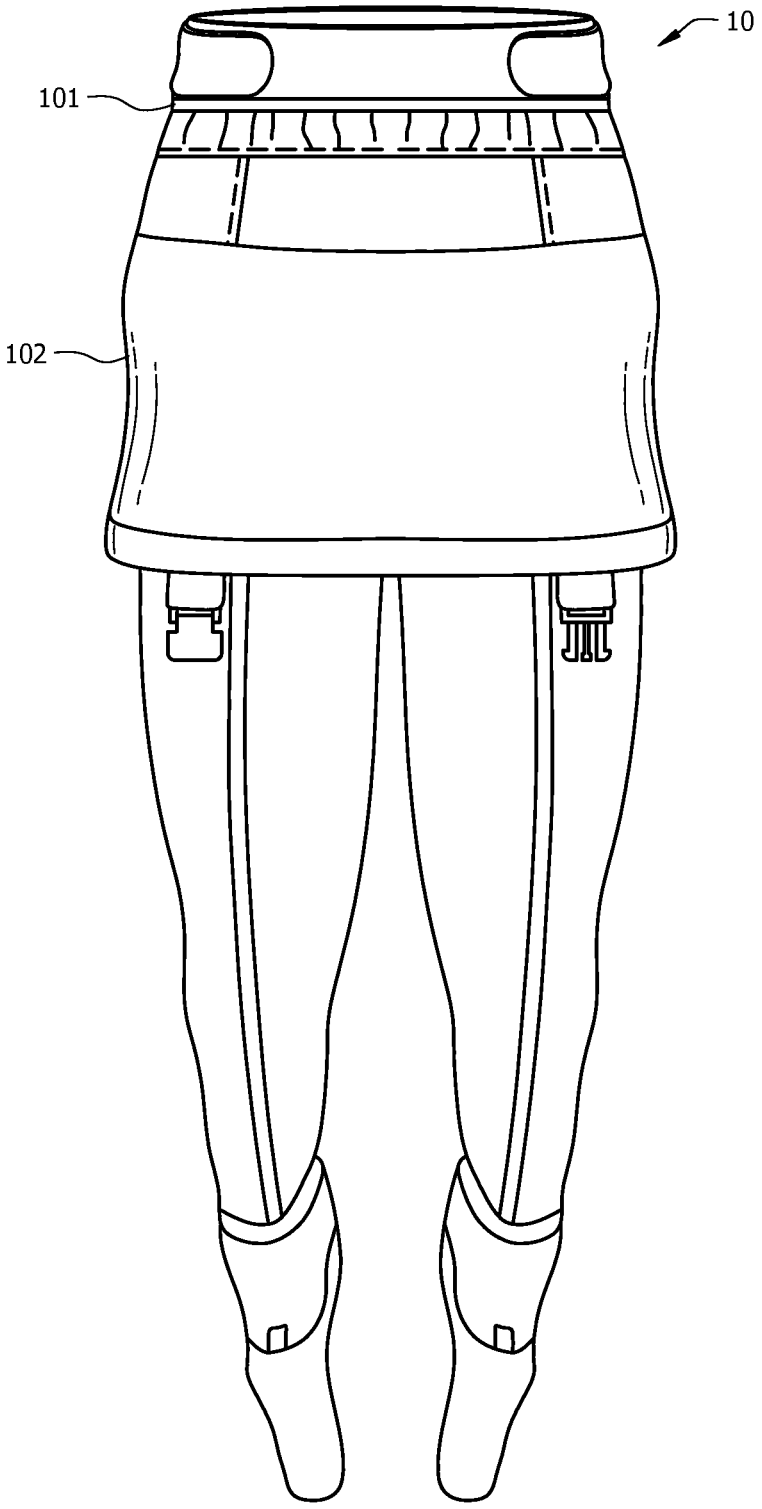
FIG. 1 depicts a view of water-resistant waders incorporating a waist lock system according to an embodiment of the present disclosure.
Figure 2:
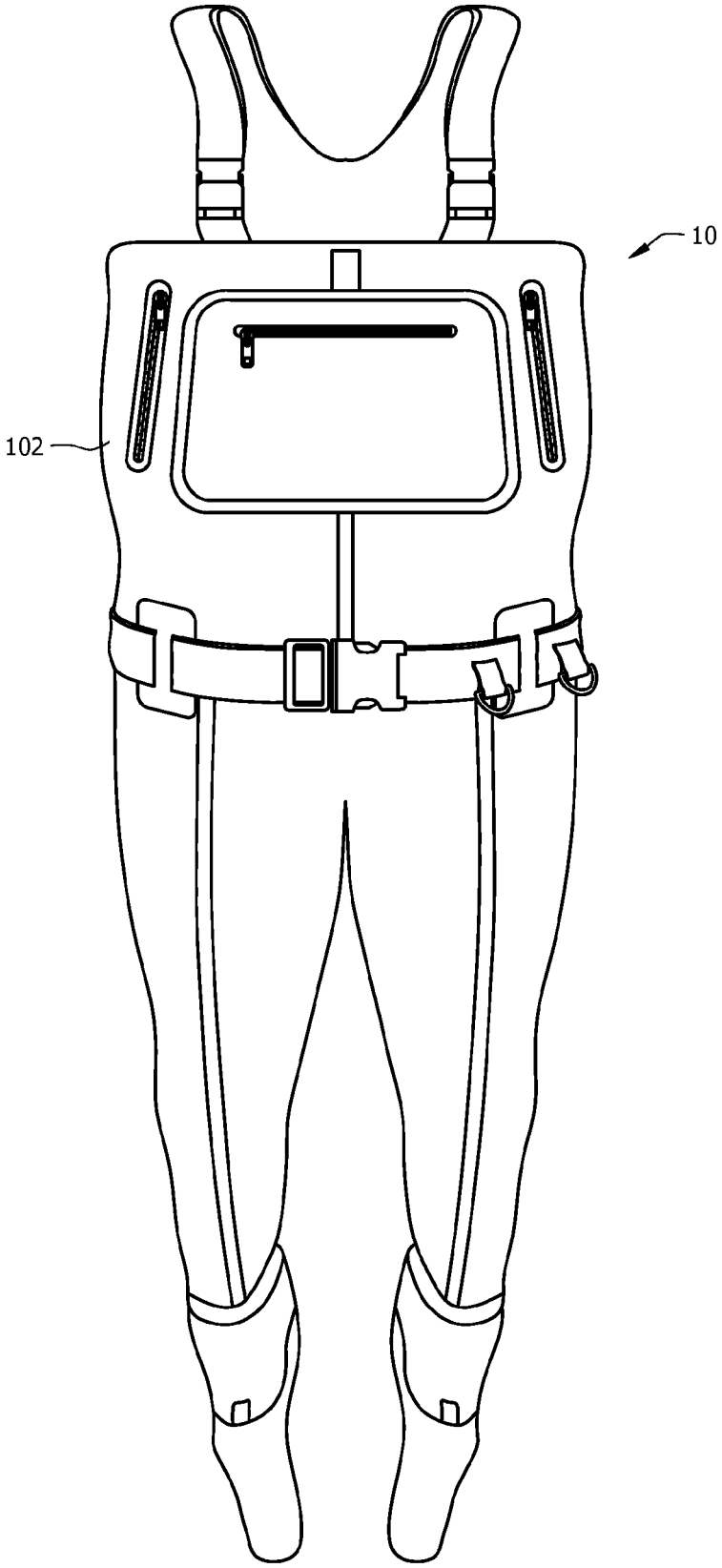
FIG. 2 depicts a full view of water-resistant waders according to an embodiment of the present disclosure.

Waders, such as water-resistant waders 10 depicted, for example, in FIGS. 1 and 2, may comprise a lower portion including leg portions to receive a wearer's legs and foot-covering components. Waders also may comprise a hip-waist portion as well as an upper chest portion to protect the upper portion of the wearer's body. Waders may further comprise straps or suspenders affixed near the upper portion of the waders to assist the wearer in keeping the waders in place during use. It should be appreciated that waders may generally be formed of a breathable fabric or material that is water-resistant or waterproof according to embodiments of the present disclosure. Fabrics or materials may include but are not limited to vulcanized rubber, polyvinyl chloride (PVC), polyurethane, silicone elastomer, neoprene, polyester, nylon or other breathable waterproof or water-resistant fabrics and combinations thereof.

FIG. 1 depicts the lower portion of water-resistant waders 10 according to an embodiment of the present disclosure. In this embodiment, upper chest wader portion 102 of water-resistant waders 10 is depicted as folded down so that waist lock system 101 may be more easily displayed. In contrast, FIG. 2 depicts a full view of an embodiment of water-resistant waders 10 when upper chest wader portion 102 is put back into position (i.e., is unfolded) and waist lock system 101 is hidden from view. It should be appreciated that waist lock system 101 may be built into water-resistant waders 10 as depicted in FIG. 1. However, in other embodiments of the present disclosure, waist lock system 101 may be removably attached to water-resistant waders 10 such as through a zipper or other attachment mechanism wherein a seal may be maintained between waist lock system 101 and upper chest wader portion 102 of water-resistant waders 10.

Figure 3:
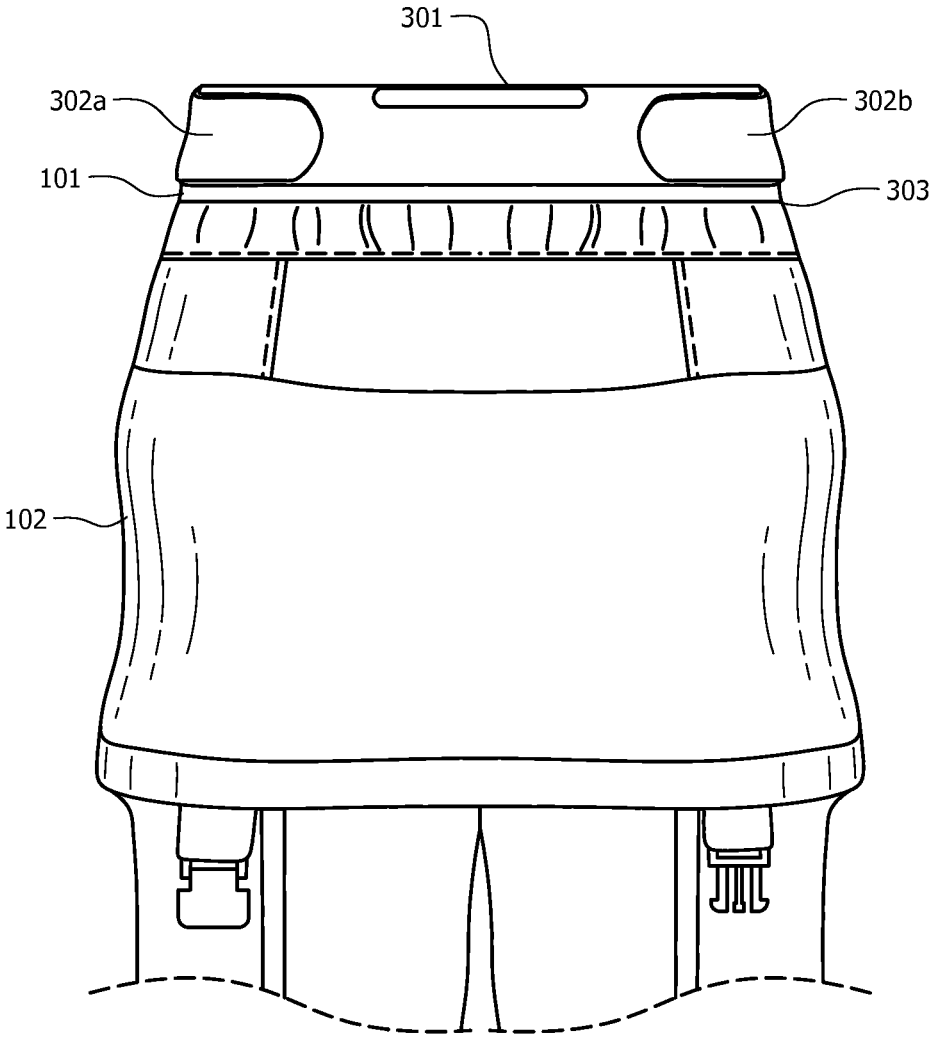
FIG. 3 depicts an exploded view of a waist lock system according to an embodiment of the present disclosure.

FIG. 3 depicts an exploded view of waist lock system 101 when upper chest wader portion 102 of water-resistant waders 10 has been folded down according to an embodiment of the present disclosure. Waist lock system 101 may comprise several components including but not limited to band 301, adjustable side straps 302*a*, 302*b*, and seamtape 303. Each of these components will be described in more detail below.

Waist lock system 101 may include band 301. It should be appreciated that a band, such as band 301, generally may fit around a wearer's waist area, but may sit higher or lower on a wearer relative to his/her natural waistline, such as closer to the wearer's chest area, without departing from the present disclosure. Band 301 may be formed using a water-resistant material, such as neoprene, according to embodiments of the present disclosure. However, it should be appreciated that band 301 may be formed of other materials that are water-resistant in nature without departing from the present disclosure, including but not limited to, vulcanized rubber, polyvinyl chloride (PVC), polyurethane, silicone elastomer, polyester, nylon or other breathable waterproof or water-resistant fabrics and combinations thereof. Band 301 should be formed of a sufficient width so that it fits around a wearer's waist area tightly enough to minimize, and in some cases, prevent water from leaking into the lower portion of water-resistant waders 10. In an embodiment of the present disclosure, band 301 may be approximately 3 inches in width. However, the width of band 301 may be increased or decreased without departing from the present disclosure. For example, band 301 may have an increased width when a wearer has a larger waist area. Similarly, band 301 may be less than 3 inches in width for a wearer that may have a more petite waist area.

Band 301 may include one or more adjustable side straps 302*a*, 302*b* on either side or on both sides of band 301 according to embodiments of the present disclosure. Adjustable side straps 302*a*, 302*b* may be employed to adjust band 301 to better fit the waist area of a wearer (i.e., tighten or loosen the fit of and 301 for the wearer). It should be appreciated that side straps 302*a*, 302*b* may be fastened and/or adjusted through various mechanisms. In this embodiment of the present disclosure, adjustable side straps 302*a*, 302*b* are adjusted by employing a fabric hook-and-loop fastener, such as Velcro®, wherein adjustable side straps 302*a*, 302*b* may include fabric strips with tiny hooks and a portion of band 301 may include fabric strips with loops to receive the hooks and fasten/bind together. However, it should be appreciated that other mechanisms for fastening/binding may be employed without departing from the present disclosure.

Figure 4A:
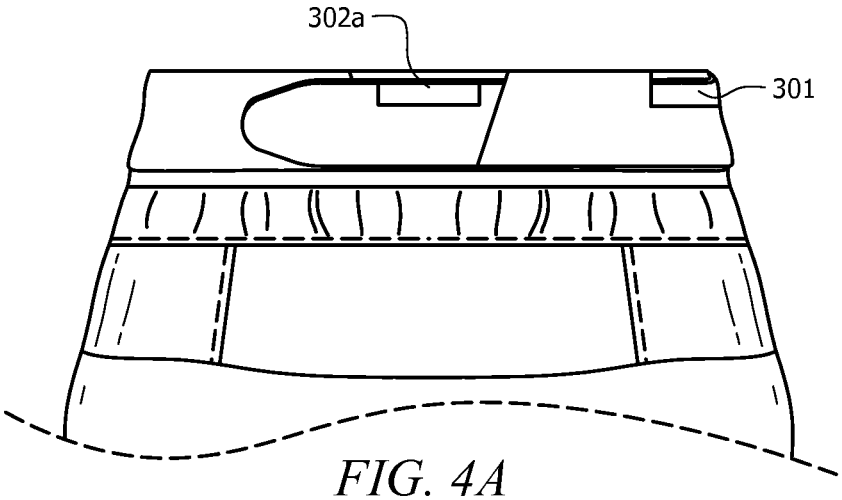
FIGS. 4A and 4B depict side views of a waist lock system according to an embodiment of the present disclosure.
Figure 4B:
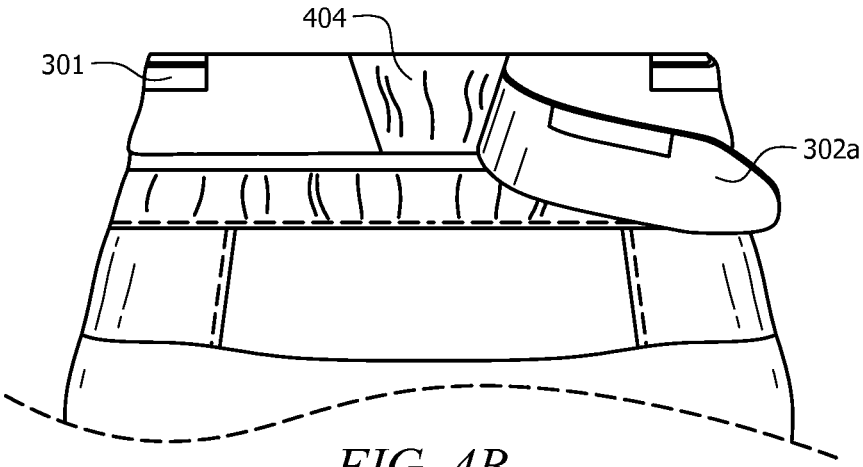

FIGS. 4A and 4B depicts side views of a waist lock system according to an embodiment of the present disclosure, such that adjustable side strap 302*a* may be more easily viewable. Both FIGS. 4A and 4B depict an adjustable side strap employing a fabric hook-and-loop fastening mechanism as previously described. FIG. 4A provides an expanded view of how adjustable side strap 302*a* having a hook-and-loop fastening mechanism may be positioned when it is fastened in place according to an embodiment of the present disclosure.

FIG. 4B depicts adjustable side strap 302*a* in an open position according to an embodiment of the present disclosure. This embodiment includes self-fabric shell side seam 404 which may be a cutout comprising a fabric, such as neoprene, to provide additional flexibility within band 301. However, it should be appreciated that side seam 404 may be formed of other materials that are water-resistant in nature without departing from the present disclosure, including but not limited to, vulcanized rubber, polyvinyl chloride (PVC), polyurethane, silicone elastomer, polyester, nylon or other breathable waterproof or water-resistant fabrics and combinations thereof. As wearers of water-resistant waders incorporating a waist lock system may be different sizes (i.e., have different weights and/or waist area sizes), inclusion of side seam 404 as part of band 301 may allow for easier adjustment by a wearer.

Seamtape 303 may be disposed between band 301 and upper chest wader portion 102 to attach band 301 to upper chest wader portion 102 according to an embodiment of the present disclosure. Seamtape 303 may be formed of polyurethane according to embodiments of the present disclosure. However, it should be appreciated that seamtape 303 may be formed of other materials that are water-resistant in nature without departing from the present disclosure, including but not limited to, neoprene, vulcanized rubber, polyvinyl chloride (PVC), silicone elastomer, polyester, nylon or other breathable waterproof or water-resistant fabrics and combinations thereof. Upper chest wader portion 102 may be formed of a fabric such as 3, 4, or 5-ply polyester, taslon, nylon, polyester or combinations thereof insofar as these types of fabrics may adhere well to seamtape 303. It should be appreciated that seamtape 303 generally may be placed on the outer portion of waist lock system 101. Seamtape 303 generally may not be included in the interior portion of waist lock system 101 insofar the interior portion of system 101 already may include a form of seamtape that may bind other portions of water-resistant waders 10 together according to embodiments of the present disclosure. However, in embodiments where no seamtape is already included as part of the interior of waist lock system 101, an interior seamtape may be incorporated without departing from the present disclosure.

In other embodiments of the present disclosure, band 301 may include gripper dots disposed as part of the interior of band 301 (i.e., the portion of band 301 resting against the wearer's waist area). These gripper dots may provide for more secure adhesion of waist lock system 101 to the wearer, such that it may be even less likely that water may enter the bottom portion of water-resistant waders 10 below the wearer's waist area.

Water-resistant waders incorporating a waist lock system according to embodiments of the present disclosure may allow the portions of the wearer's body below the waist lock system that are covered by the waders to generally remain dry if water spills over the waders during use due to the flap and seal structure of the waist lock system. In addition, given how the band of the waist lock system may be formed, such as by including gripper dots, adjustable side straps and/or a fabric shell side seam, a wearer of the waders incorporating a waist lock system may may feel comfortable and relatively dry during use.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A waist lock system for water-resistant waders comprising:

a band having an inner portion facing toward a wearer of the waist lock system and an outer portion facing away from the wearer, the band formed of a water-resistant material and having at least one adjustable side strap to adjust the band around a waist area of the water-resistant waders; and a water-resistant stretchable seamtape placed on the outer portion of the band to attach the band to an upper chest wader portion of the water-resistant waders, the upper chest wader portion located above the band, wherein the waist lock system is water-resistant.

2. The waist lock system of claim 1 further comprising:

gripper dots disposed within the interior of the band.

3. The waist lock system of claim 1 wherein the water-resistant material is selected from the group comprising:

vulcanized rubber, polyvinyl chloride (PVC), polyurethane, silicone elastomer, neoprene, polyester, and nylon.

4. The waist lock system of claim 1 where the band includes adjustable side straps on both sides of the band.

5. The waist lock system of claim 1 wherein the at least one adjustable side strap is adjusted via a fabric hook-and-loop fastener.

6. The waist lock system of claim 1, the band further comprising:

a side seam.

7. The waist lock system of claim 1 wherein the water-resistant stretchable seamtape is selected from the group comprising:

vulcanized rubber, polyvinyl chloride (PVC), polyurethane, silicone elastomer, neoprene, polyester, and nylon.

8. Water-resistant waders incorporating a water-resistant waist lock system, the waders comprising:

an upper chest wader portion; and the water-resistant waist lock system integrated into the waders, the water-resistant waist lock system comprising a water-resistant band having an inner portion facing toward a wearer of the waist lock system and an outer portion facing away from the wearer, the band affixed to the upper chest wader portion with a water-resistant stretchable seamtape, wherein the upper chest wader portion is the portion of the waders located above the water-resistant band, the seamtape is placed on the outer portion of the band, and the water-resistant waist lock system is hidden from view when the upper chest wader portion is in an unfolded position.

9. The waders of claim 8, the waist lock system further comprising:

at least one adjustable side strap to adjust the band around a waist area.

10. The waders of claim 9 wherein the at least one adjustable side strap is adjusted via a fabric hook-and-loop fastener.

11. The waders of claim 8, the waist lock system further comprising:

gripper dots disposed within the interior of the band.

12. The waders of claim 8 wherein the water-resistant band is formed of a material selected from the group comprising:

vulcanized rubber, polyvinyl chloride (PVC), polyurethane, silicone elastomer, neoprene, polyester, and nylon.

13. The waders of claim 8, the waist lock system further comprising:

a self-fabric shell side seam.

14. The waist lock system of claim 8 wherein the water-resistant seamtape is formed of a material selected from the group comprising:

vulcanized rubber, polyvinyl chloride (PVC), polyurethane, silicone elastomer, neoprene, polyester, and nylon.

15. A water-resistant waist lock system for waders, the water-resistant waist lock system comprising:

a ring of water-resistant material firmly positioned around a waist area of the waders, the waist area located between an upper chest portion and a lower portion of the waders, wherein the ring has an inner portion facing toward the waist area and an outer portion facing away from the waist area and wherein the ring is positioned to prevent water from leaking into the lower portion of the waders; and a water-resistant stretchable seamtape placed on the outer portion of the ring of water-resistant material to attach the ring to the upper chest portion of the waders, wherein the waist lock system is water-resistant.

16. The waist lock system of claim 15 further comprising:

gripper dots disposed within the interior portion of the ring of water-resistant material.

17. The waist lock system of claim 15, the ring of water-resistant material further comprising:

at least one adjustable side strap to adjust the ring of water-resistant material around the waist area.

18. The waist lock system of claim 17, wherein the at least one adjustable side strap is adjusted via a fabric hook-and-loop fastener.

19. The waist lock system of claim 15, the ring of water-resistant material further comprising:

a self-fabric shell side seam.

* * * * *